United States Patent [19]

Jones et al.

[11] 4,286,610

[45] Sep. 1, 1981

[54] PEDICURE IMPLEMENT

[75] Inventors: John E. Jones, Danville; William G. Fodor, Blairs; James R. Porter, Danville, all of Va.; James E. Edgell, Senatobia, Miss.

[73] Assignee: Sandvik, Ind., Greensboro, N.C.

[21] Appl. No.: 157,672

[22] Filed: Jun. 9, 1980

[51] Int. Cl.[3] ..... A45D 29/04

[52] U.S. Cl. ..... 132/76.4; 29/80

[58] Field of Search ..... 132/73, 76.4, 75.6, 132/75.3, 76.5, 73.5; 29/78, 79, 80

[56] References Cited

U.S. PATENT DOCUMENTS

| | | | |
|---|---|---|---|
| 811,992 | 2/1906 | Angus et al. | 132/75.6 |
| 2,132,889 | 10/1938 | Ayres | 132/76.5 |
| 4,211,246 | 7/1980 | Hokama | 132/76.4 |

*Primary Examiner*—G. E. McNeill
*Assistant Examiner*—Mickey Yu
*Attorney, Agent, or Firm*—B. B. Olive

[57] ABSTRACT

A pedicure implement comprises an integral, plastic molded handle structure on the base of which are mounted upwardly angled fine and coarse abrading strips formed of thin stainless steel with the shape and mounting arrangement being designed for ease of use in pedicure-manicure operations.

1 Claim, 8 Drawing Figures

PEDICURE IMPLEMENT

BACKGROUND OF THE INVENTION

1. Field of the Invention

The present invention relates to handheld and manipulated foot pedicure implements.

2. Description of the Prior Art

Over the years, many devices have been developed to provide filing and buffing implements for manicure and pedicure use. At least some of these devices have more than one working surface or means for providing different attachments to a working surface. U.S. Pat. Nos. 454,956; 1,643,164 and 4,184,499 are illustrative of the art to which the present invention relates and over which the present invention is intended to offer an improvement.

SUMMARY OF THE INVENTION

The pedicure implement of the invention comprises an integral molded handle structure on the bottom of which are mounted two tapered strips of abrading material. One of the strips provides relatively coarse abrasion while the other strip provides relatively fine abrasion. The shape of the handle structure is intended to provide an extremely comfortable and easily manipulated implement for foot pedicure, callus removal and similar operations on the body.

DESCRIPTION OF THE PREFERRED EMBODIMENT

Figure 1:
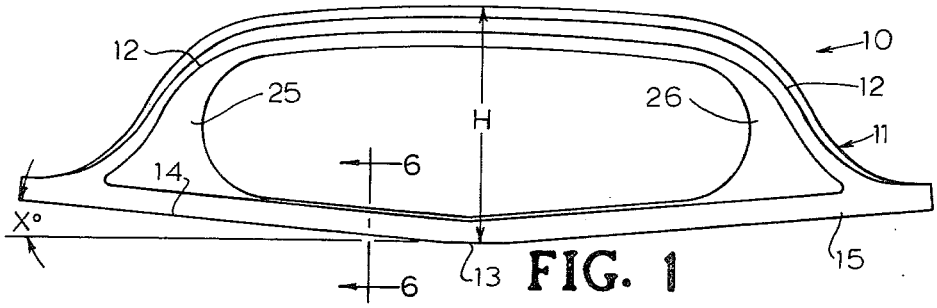
FIG. 1 is a side elevation view of a pedicure implement according to the invention.
Figure 2:
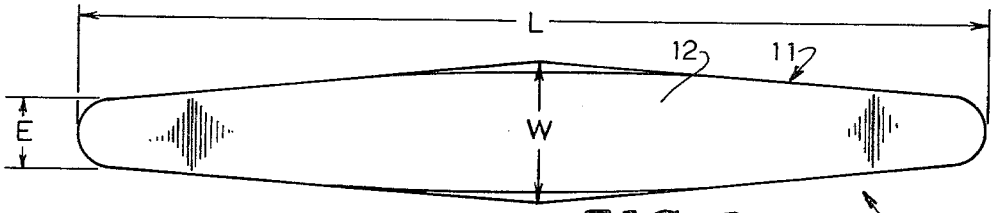
FIG. 2 is a top plan view of the implement of FIG. 1.
Figure 3:
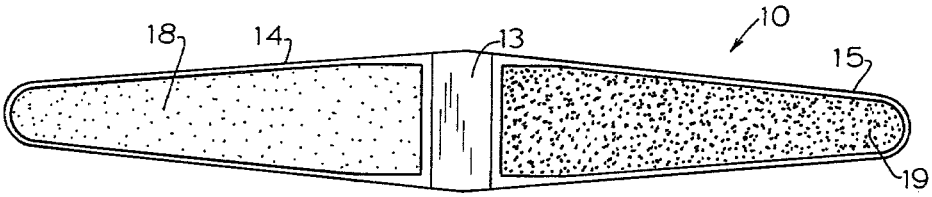
FIG. 3 is a bottom plan view of the implement illustrating the fine and coarse abrading strips employed.
Figure 4:
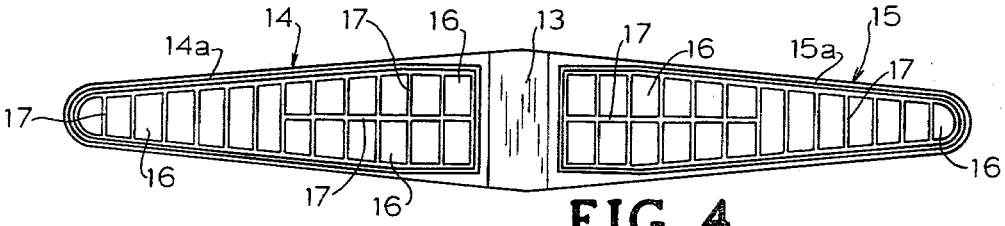
FIG. 4 is a bottom plan view of the implement with the abrader strips removed and illustrating the rib-recess support structure on which the strips are mounted.
Figure 5:
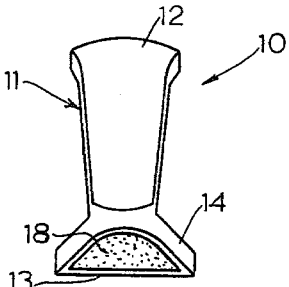
FIG. 5 is an end elevation view of the implement.
Figure 6:
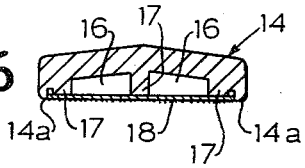
FIG. 6 is an enlarged section view taken substantially along line 6—6 of FIG. 1.

Referring to the drawings, a pedicure implement according to the invention is generally designated 10 and comprises a symmetrically formed, lightweight, evenly balanced, plastic molded frame 11, on the bottom of which are mounted the later-described fine abrader strip 18 and coarse abrader strip 19. Frame 11 is formed with the illustrated closed loop handle 12 extending between the ends of the implement 10 and providing on the base of frame 11 a slightly upwardly curved intermediate smooth base section 13 located between and forming extensions of the slightly upwardly angled work surface support sections 14, 15.

Work surface sections 14, 15 are molded with cavities 16 and reinforcing ribs 17 formed in the bottom thereof. Ribs 17 are slightly recessed below the plane of the peripheral edges 14*a*, 15*a* so as to form relatively shallow, generally triangular shaped cavities in the respective work surfaces 14, 15 for receiving the abrader strips 18, 19 of conforming shape.

A special advantage of the implement 10 of the invention resides in the choice of material chosen for the abrader strips 18, 19. These strips are formed of a very thin, flexible, over etched, stainless steel material made according to the process taught in U.S. Pat. No. 3,045,321. In the specific embodiment of the invention being described, the relatively fine abrasive surface provided by abrader strip 18 is formed from the mentioned type of stainless steel with 165 spots/cm$^2$. The relatively coarse abrader strip 19 is formed with 45 spots/cm$^2$ with such terminology being according to the terminology understood by those skilled in the making of this type of abrasive material, with the assignee of the present invention, Sandvik, Inc., being one such source of the material.

Figure 7:
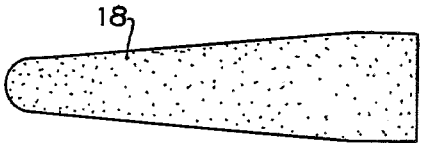
FIG. 7 is a top plan view of one of the abrader strips employed with the invention.
Figure 8:
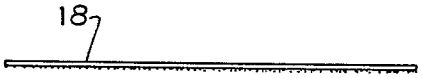
FIG. 8 is a side elevation view of the abrader strip of FIG. 7.

Abrader strips 18, 19 are shaped as best illustrated in FIG. 7 and are secured by having a suitable waterproof adhesive placed on the back of the strips 18, 19, after which the strips 18, 19 are pressed into place and the excess adhesive is allowed to enter the previously-mentioned recesses 16 thus providing a very rapid form of assembly.

In use, the pedicure implement 10 of the invention may be used, for example, for rough removal of hard calluses by first using the relatively coarse abrader strip 19 followed by use of the relatively fine abrader strip 18 for finer finishing of the skin surface. In such use, the relatively smooth intermediate surface 13 on the bottom of implement 10 allows either abrader strip 18 or abrader strip 19 to be used without engaging the strip not being employed. Also, it has been found that the triangular shape of the perspective work surfaces 14, 15 and the corresponding abrader strips 18, 19 provide for easy access to the various crevices of the foot or hand. A further advantage resides in the fact that the type of thin, stainless steel abrading material employed in the unique implement configuration of the invention results in an implement which is entirely washable. Further, as compared to the normal sandpaper type of pedicure-manicure implements, the implement 10 of the invention provides a substantial improvement with regard to its hygienic character. When not in use, the pedicure implement 10 may sit upright and rest on the centerline of the intermediate section 13 as illustrated in FIG. 1 which inherently maintains the abrader strips 18, 19 out of contact with the table or other surface on which the implement 10 is being supported.

All of the outer surfaces of implement 10 are preferably smooth surfaced and the upright handle support portions 25, 26 are appropriately smoothly contoured for ease of handling when the operator's fingers are engaged through the opening below the horizontal handle 12. The dimensions of the implement 10 may vary. However, it may be noted that in a specific embodiment, the angle indicated as angle X was approximately five degrees, the overall length L was approximately six inches, the maximum width dimension W was approximately one inch, the narrow width dimension E was approximately one-half inch and the overall height H was approximately one and one-half inches. Thus, an extremely lightweight and versatile implement was provided.

What is claimed is:

1. A pedicure-manicure implement, comprising:

(a) an integral, smooth surfaced, plastic molded elongated body having:

(i) an elongated horizontally disposed handle above a finger grip opening;

(ii) smoothly contoured upright molded handle support portions extending from opposite ends of said handle and located proximate the outer ends of said body; and (iii) a base portion providing a pair of generally triangular-shaped outer base sections extending outwardly from a generally rectangular smoothly curved and surfaced central base section, said outer base sections each having a rib-recess configuration within and recessed inwardly from the respective plane of surrounding edge portions defining each respective said triangular shape of each said outer base section and with said base section planes being slightly angled upwardly with respect to a horizontal plane when said implement rests thereon supported by said central base section;

(b) a pair of thin, flexible, stainless steel, etched-type abrader strips, one being relatively coarse and the other being relatively fine and being of a generally triangle shape conforming to the said outer base section recesses and respectively mounted therein; and (c) adhesive means applied to the respective back surfaces of said strips to secure said strips to said ribs.

* * * * *